United States Patent [19]

Salomon

[11] 4,076,274

[45] Feb. 28, 1978

[54] SKI BRAKES

[75] Inventor: Georges Pierre Joseph Salomon, Annecy, France

[73] Assignee: Societe Anonyme des Etablissements Francois Salomon & Fils, Annecy, France

[21] Appl. No.: 680,514

[22] Filed: Apr. 26, 1976

[51] Int. Cl.[2] ..... A63C 7/10; A63C 11/02

[52] U.S. Cl. ..... 280/605

[58] Field of Search ..... 280/605, 604, 601, 611

[56] References Cited

U.S. PATENT DOCUMENTS

| | | | |
|---|---|---|---|
| 3,924,864 | 12/1975 | Weigl | 280/605 |
| 3,989,271 | 11/1976 | Riedel | 280/605 |

FOREIGN PATENT DOCUMENTS

| | | | |
|---|---|---|---|
| 144,581 | 2/1936 | Austria | 280/605 |
| 154,159 | 3/1938 | Austria | 280/605 |
| 701,560 | 1/1965 | Canada | 280/605 |
| 2,228,506 | 12/1974 | France | 280/605 |
| 2,417,279 | 10/1974 | Germany | 280/605 |
| 2,430,812 | 1/1975 | Germany | 280/605 |

*Primary Examiner*—David M. Mitchell

*Attorney, Agent, or Firm*—Haseltine, Lake & Waters

[57] ABSTRACT

A ski brake comprising at least one spade mounted in a pivot to rotate about an axis between an inactive position in which it is retracted above the ski when a boot is placed on the ski and an active position in which it projects below the sole of the ski. A mechanism is provided for moving the spade from the inactive position into the active position. The axis of the spade is inclined downwards towards the longitudinal axis of the ski and towards the front or rear of the ski so that the spade can move between its active and inactive positions by a rotation of less than 180°, enabling association of the brake with known step-in devices.

11 Claims, 9 Drawing Figures

FIG.1
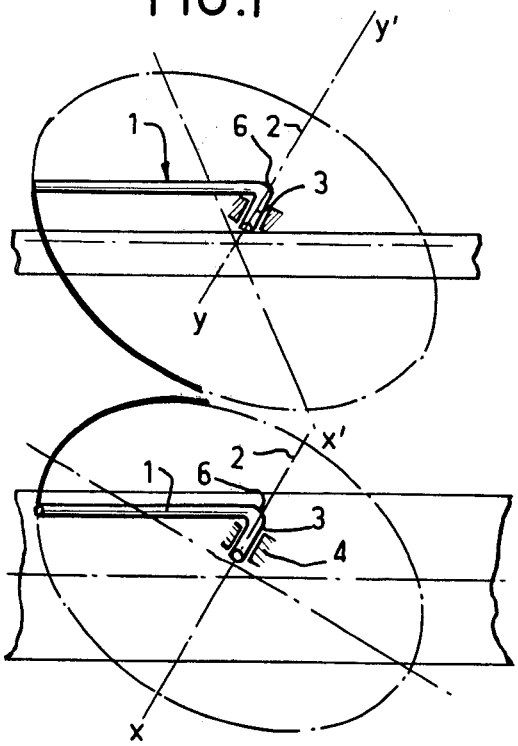
FIG.3
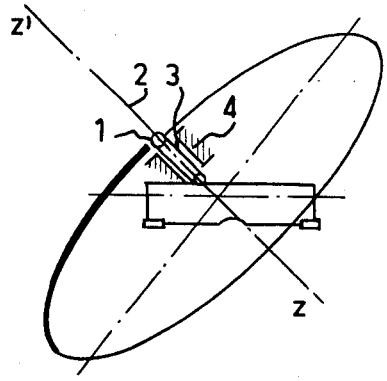
FIG.2
FIG.4
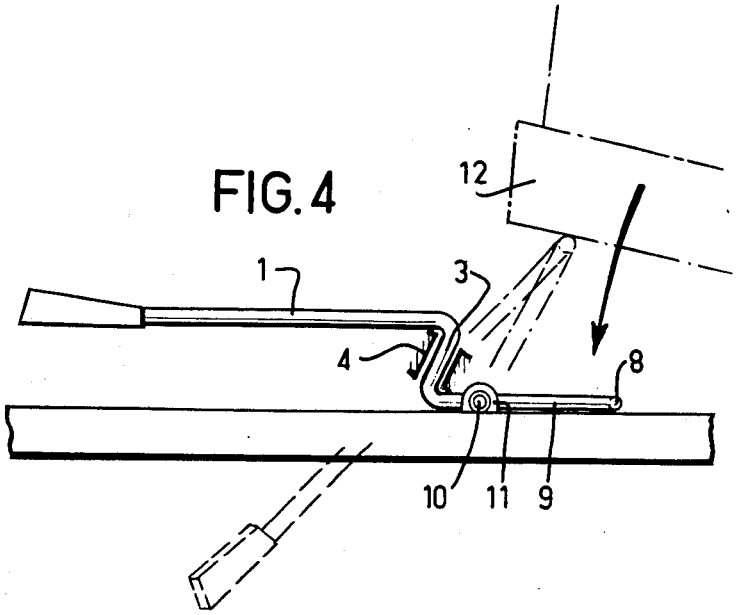

SKI BRAKES

FIELD OF THE INVENTION

The present invention relates to a ski brake, i.e. a device intended to prevent a ski from sliding down a slope when the ski is no longer connected to the skier after a safety binding has been released subsequent to a fall of the skier. A device of this type thus replaces the safety strap currently used.

BACKGROUND

Such devices generally comprise at least one arresting arm forming a "spade" and mounted to rotate with respect to the ski. The spade is normally in an active braking position, in which it projects below the sole of the ski, the spade being biased into this position by an energizing device comprising a resilient member. When a boot is engaged in a binding supported by the ski however, the boot maintains the spade in an inactive position in which it may be located above the upper surface of the ski.

When the binding of the ski is released, the spade moves into the active position and penetrates the snow to a greater or lesser extent, immobilizing the ski so that it may be recovered by the skier easily. There is thus no danger of the ski sliding down the slope and injuring a skier located below, or of the ski becoming lost.

Various ski brakes are already known in which the axis of rotation of the spade is parallel to the plane of the upper surface of the ski, but inclined with respect to the longitudinal axis of the latter. In these brakes, the spade is returned above the ski at the time of fitting the ski, but this requires the spade to travel through approximately 270°, which excludes the use of such brakes with "step-in" devices and of advantageous energising mechanisms. In these brakes the spade forms an angle greater than 90° with its axis of rotation and it describes a cone when rotated.

Other brakes are also known in which the axis of rotation of the spade is located in a transverse plane with respect to the ski and is inclined in a downwards direction and from the outside inwards. In this case, the spade is perpendicular to its axis of rotation and when rotated it defines a plane located partly above the ski.

All these arrangements have not proved completely satisfactory, either because they do not make it possible to use simple energizing mechanisms, or because they have too great a bulk as regards height.

SUMMARY OF THE INVENTION

It is an object of the present invention to remedy these drawbacks by providing a ski brake of very simple construction obtained by means of a particular arrangement of the axis of rotation of the spade.

Accordingly, the present invention provides a ski brake comprising at least one spade mounted in a pivot to rotate about an axis between an inactive position in which it is retracted above the ski when a boot is placed on said ski and an active position in which it projects below the sole of said ski, and energizing means for moving said spade from said inactive position into said active position, said axis of said spade being inclined downwards towards the longitudinal axis of said ski and towards the front or rear of said ski.

This particular arrangement of the axis of rotation, which is inclined with respect to three reference planes constituted by the horizontal plane of the upper surface of the ski, the vertical plane passing through the longitudinal axis of the ski and the vertical tranverse plane, enables the spade to move from its inactive position into its active position and vice versa by a rotation clearly less than 180°, thus describing a cone.

Due to this short travel, the ski brake according to the invention may easily be associated with known step-in devices. Furthermore, in the inactive position, the spade is clearly above the upper surface of the ski and in no way hinders the use of the latter.

BRIEF DESCRIPTION OF THE DRAWING

Various embodiments of the present invention will be described hereafter, as non-limiting examples, with reference to the accompanying drawings in which:

FIGS. 1, 2 and 3 are respectively an elevational view, a plan view and a diagrammatic profile view of a pivoting spade of a ski brake according to the invention.

FIGS. 4 and 5 are an elevational view and plan view respectively of one embodiment of a ski brake.

DETAILED DESCRIPTION

Figure 5:
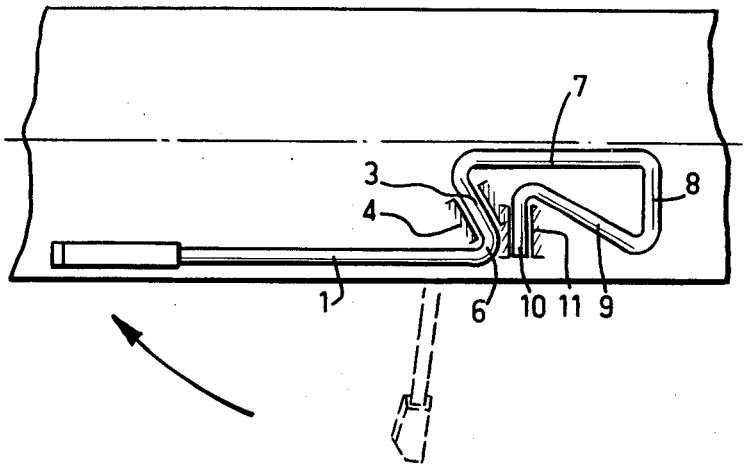

The ski brake according to the invention, whose main constituent parts are shown diagrammatically in FIG. 1, comprises essentially a spade 1, constituting an arresting arm intended to dig into the snow, which is mounted to rotate about an axis 2 materialized by a pivot 3 mounted in a bearing 4 supported by the ski.

The intangible axis of rotation 2 of the spade 1 is indicated by its projections in three perpendicular planes, namely its projection *XX'* in a horizontal plane (FIG. 2), its projection yy' in a vertical and longitudinal plane, i.e. parallel to the axis of the ski (FIG. 1) and its projection *zz'* in a vertical and transverse plane (FIG. 3).

According to the invention, this axis 2 is inclined with respect to the horizontal plane of the ski (projection *yy'*) and also with respect to a transverse vertical plane (projection *xx'*). The axis 2 is thus inclined in a downwards direction towards the inside of the ski and towards the rear of the latter.

According to another feature of the invention, the spade 1 and its pivot 3 form an angle less than 90°. In all the figures of the drawings, the spade 1 is shown in full lines in the inactive position and in broken lines in the active position. In the inactive position, the spade 1 extends above the ski, being substantially parallel to the upper surface of the latter. It extends towards the rear of the ski from the pivot 3.

Preferably, the spade 1 forms a single bent part with the pivot 3.

When moving into the active position, the spade 1 describes a portion of a cone having an axis 2 and apex 6 constituted by the bend of the spade 1 and of the pivot 3 materializing the axis.

FIGS. 1 to 3 show the projection ellipses of the basic circle described by the free end of the spade 1, if the latter were able to describe a complete cone. Marked as a thick line on these ellipses is the part of the trajectory effectively followed by the end of the spade 1 between its active and inactive positions.

A first embodiment of the brake according to the invention will now be described with particular reference to FIGS. 4 and 5. In this case, the spade 1 and pivot 3 are constituted by a rod or wire of considerable diameter having resilient properties, for example, an iron wire made from spring-steel. As previously, the pivot 3 which materializes the axis of rotation of the spade 1 is inclined downwards towards the central axis of the ski and towards the rear of the latter. At its lower end opposite the bend 6 forming the apex of the cone described, this pivot is extended by an inner longitudinal arm 7 extending forwards and substantially parallel to the spade 1 proper. In the inactive position (FIG. 5), the front arm 7 is pressed against the upper side of the ski, in the vicinity of the longitudinal axis of the latter, whereas the rear spade 1 extends parallel to the upper surface of the ski, at a certain level above the latter, rearwards.

At its front end, the arm 7 is in turn extended by a transverse web 8 whose end is bent towards the rear, thus forming an elbow. This elbow is extended towards the rear of the ski by an outer arm 9 which is inclined towards the axis of the ski, is thus directed towards the inner front arm 7. The outer arm 9 is in turn bent outwards, at its rear end, to form an extreme transverse finger member 10 housed in a guide bearing 11, in which it may be prevented from moving in translation.

From the aforesaid, it will be seen that the inner arm 7, the transverse web 8 and the outer arm 9 form a loop open towards the rear and which is elastically deformable.

The guide bearing 11 for the extreme transverse finger member 10 is located in front of the rotary bearing 4 for the pivot 3.

When the spade is in the active position (shown in broken lines in FIGS. 4 and 5), the arms 7 and 9 and the web 8 extend forwards above the ski and form a pedal on which may bear the heel of the boot 12 when the ski is re-fitted. The spade 1 is kept in the active position by its own tension, due to deformation of the rod or resilient wire constituting the latter, or even under the action of an appropriate energizing device able to be incorporated in the bearing 4 in particular.

The pedal formed by the two arms 7, 9 and the web 8 also constitute a loop whose two lateral arms 7, 9 form a variable angle and due to which may accumulate a certain amount of energy subsequent to its elastic deformation. When the heel of the boot 12 presses on the pedal 7, 8, 9, the spade 1 passes from its active position into its inactive position, rotating substantially in clockwise direction, as shown by the arrows in FIGS. 4 and 5. During this pivoting movement, at a certain instant, the inner arm 7 is placed against the surface of the ski, whereas the web 8 and outer arm 9 are still inclined upwards and towards the outside of the ski. By continuing to exert pressure by means of the heel of the boot 12 on the web 8 and outer arm 9, the loop is deformed by twisting about the axis of the inner arm 7 and one thus accumulates a certain amount of elastic energy, which is restored at the time of the releases and which promotes the passage of the spade 1 from its inactive position into its active position.

It is naturally possible to envisage any other construction of the pedal forming a part with the spade 1, in order to enable it to deform by bending and/or twisting and this is in order to accumulate a certain amount of energy.

Figure 6:
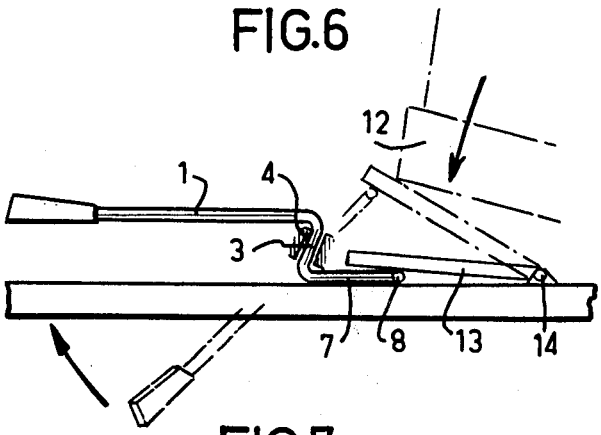
FIGS. 6 and 7 are an elevational view and a plan view respectively of one variation of the ski brake.
Figure 7:
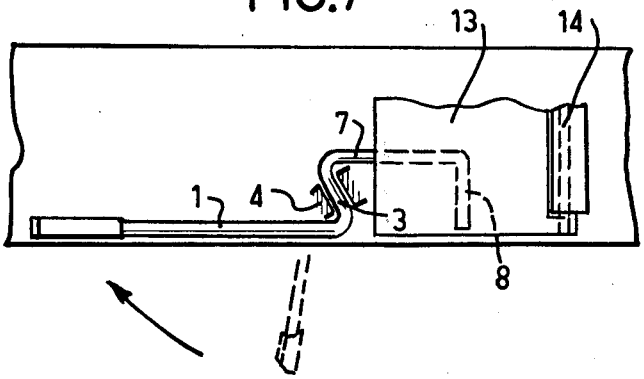

In the variation illustrated in FIGS. 6 and 7, the pivot 3 of the brake is extended towards the front by the inner longitudinal arm 7 and the transverse web 8. The latter constitutes a pedal on which bears the heel of the boot 12 either directly, or by means of a small plate 13 pivoted on the ski, at its front part, about a transverse pivot 14 when the boot is mounted on the ski. In this case, it is necessary to provide an attached energizing device for moving the spade 1 from its inactive position into its active position, owing to the fact that the spade pivots freely in its bearing 4, without being subject to any elastic force.

Figure 8:
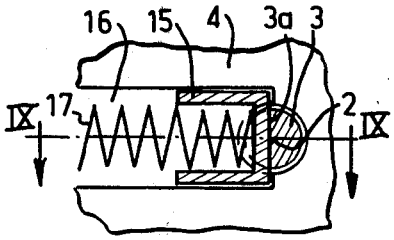
FIG. 8 is a cross-sectional view, to an enlarged scale, of a device for energizing the spade, the latter being in the active position.
Figure 9:
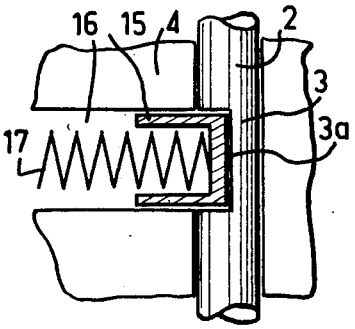
FIG. 9 is an axial sectional view taken on line IX—IX of FIG. 8.

To ensure this energizaton, it is possible to provide a device such as that shown in FIGS. 8 and 9, in the bearing 4. This device comprises a piston 15 housed in a recess 16 provided in the body of the bearing 4 transversely with respect to the axis of rotation 2 of the pivot 3 of the spade. This piston 15 is pushed back constantly against the lateral surface of the pivot 3 by a compression spring 17 provided in the housing 16. The pivot 3 comprises a diametral flat part 3*a* against which the piston 15 bears when the spade is in the active position, which is the position shown in FIGS. 8 and 9. As soon as the spade moves away from its active position in order to pass into its inactive position, one of the extreme edges defining the flat part 3*a* pushes the piston 15 against the action of the spring 17, which has the effect of compressing the latter, with a view to the automatic passage of the spade into the active position.

An energising device of this type may be used solely when the pivoting travel of the spade 1 is a maximum of 90°. This device of particularly simple design may thus be used advantageously in the ski brake according to the invention, since the spade 1 rotates through less than 90° about its axis 2, to move from its active position into its inactive position and vice versa.

In all the embodiments of the invention which have been described, the axis of rotation 2 of the spade and the pivot 3 materializing the latter have been shown and described as being inclined in a downwards direction towards the inside of the ski and towards the rear. Nevertheless, this arrangement is in no way limiting, since a similar but reverse arrangement could be envisaged, in the sense that the ski brake would be actuated by the front part of the boot. In this case, the axis of rotation 2 would be inclined towards the inside of the ski and towards the front, the spade 1 thus extending towrds the front of the ski.

It should be noted that in the inactive position, no part of the brake projects beyond the width of the ski, which is very favorable for skiing.

Naturally, the above-mentioned embodiments have been given solely as an example and are in no way limiting and several variations could be envisaged without diverging from the spirit of the invention.

One could thus energize two spades with a single loop, as shown in FIGS. 4 and 5, or simply by connecting them by wire deformed elastically at the time of re-fitting the boot to the ski, owing to the convergence of the axes.

What is claimed is:

1. In a brake mounted on a ski having a longitudinal axis, opposite longitudinal edges, and upper and lower surfaces, the brake comprising a spade lying along and above a longitudinal edge of the ski, a pivot portion connected to said spade and a pedal portion extending from the pivot portion; the pedal being adapted for engagement by a ski boot to move the spade about its pivot portion from an active position, projecting below the ski, to an inactive, retracted position above the ski, the improvement wherein said pivot portion is bent at an angle with respect to said spade, and bearing means is provided for mounting said pivot portion to rotate about an axis inclined downwardly toward the inside at an acute angle with respect to a horizontal plane through the ski, at an acute angle with respect to a transverse vertical plane through the ski and at an acute angle with respect to a longitudinal vertical plane through the ski.

2. The improvement as claimed in claim 1 wherein said pivot portion defines an acute angle with said spade.

3. The improvement as claimed in claim 2 wherein said pivot portion is integral with said spade.

4. The improvement as claimed in claim 1 wherein said pivot portion has opposite ends, said spade being integral with said pivot portion at one end thereof, and the pedal portion being integral with said pivot portion at the other end thereof.

5. The improvement as claimed in claim 4 wherein said spade is constituted as a rod.

6. The improvement as claimed in claim 4 wherein said pedal includes an arm integral with said pivot portion at said other end and a step-on portion extending laterally from said arm.

7. The improvement as claimed in claim 6 wherein said step-on portion comprises a transverse web extending from said arm, a second arm extending rearwardly from said transverse web, and a finger member extending transversely from said second arm, and a guide bearing on the upper surface of said ski pivotably supporting said second arm.

8. The improvement as claimed in claim 7 wherein the first said arm, said transverse web and said second arm constitute a loop capable of undergoing elastic deformation by twisting about said first arm when said step-on portion is depressed by mounting a boot on said ski.

9. The improvement as claimed in claim 6 wherein said means for moving comprises energizing means for acting on said pivot portion urging said spade to said active position and a plate pivotably mounted on said ski and bearing on said transverse web.

10. The improvement as claimed in claim 9 wherein said energizing means comprises a piston slidably mounted on the upper surface of said ski and a spring urging said piston against said pivot portion.

11. The improvement as claimed in claim 1 wherein said pivot portion is inclined upwardly, forwardly and laterally outwards with said spade in said inactive position.

* * * * *